US007798075B2

(12) United States Patent
Bettinger

(10) Patent No.: US 7,798,075 B2
(45) Date of Patent: Sep. 21, 2010

(54) CHOCK STABILIZED FURNITURE

(76) Inventor: David S. Bettinger, 8030 Coventry, Grosse Ile, MI (US) 48138-1119

( * ) Notice: Subject to any disclaimer, the term of this patent is extended or adjusted under 35 U.S.C. 154(b) by 0 days.

(21) Appl. No.: 12/233,568

(22) Filed: Sep. 18, 2008

(65) Prior Publication Data

US 2010/0064947 A1 Mar. 18, 2010

(51) Int. Cl.
*A47B 13/00* (2006.01)

(52) U.S. Cl. ..... 108/157.12; 108/157.17

(58) Field of Classification Search ..... 108/151, 108/157.1, 157.14–157.18, 157.12, 158.13, 108/159, 159.12; 248/188.1, 188.6, 118.91, 248/165

See application file for complete search history.

(56) References Cited

U.S. PATENT DOCUMENTS 1,072,550 A * 9/1913 Wilson ..... 108/159.12
1,094,227 A * 4/1914 Lotz ..... 108/159
1,204,648 A * 11/1916 Cavaline ..... 108/171
1,448,642 A * 3/1923 Tomlinson ..... 108/157.16
1,649,388 A * 11/1927 Cacha ..... 108/185
1,979,843 A * 11/1934 Roos ..... 108/159
1,997,182 A * 4/1935 Peck ..... 108/159
2,191,007 A * 2/1940 Bussey ..... 108/159
4,138,951 A * 2/1979 Nelson ..... 108/115
4,974,526 A * 12/1990 Wiygul, Jr. ..... 108/159
5,359,944 A 11/1994 Steinbeck
5,562,050 A 10/1996 Colquhoun
5,582,267 A * 12/1996 Bockoven et al. ..... 182/153
5,640,912 A 6/1997 Diffrient
5,954,412 A * 9/1999 Rutherford et al. ..... 312/258
6,267,065 B1 * 7/2001 Lin ..... 108/157.14

FOREIGN PATENT DOCUMENTS

DE 3933220 * 4/1991 ..... 108/151
DE 4008958 * 12/1991 ..... 108/151

OTHER PUBLICATIONS

DormBuys.com, Folding Desk, http://www.dormbuys.com/shop/product/1279.

* cited by examiner

*Primary Examiner*—Hanh V Tran
(74) *Attorney, Agent, or Firm*—Christopher Paul Mitchell

(57) ABSTRACT

A ready-to-assemble without tools furniture structure, structure-scaled duplex fastener, and assembly method having two foldable gates that clamp ends of a longitudinal diaphragm brace where the locks and keepers are the side edge faces of the vertically removable and horizontally movable top surface producing exceptional rigidity. A result is movable top access to a panel desk interior providing computer wiring and accessory management.

6 Claims, 9 Drawing Sheets

CHOCK STABILIZED FURNITURE

BACKGROUND

1. Field

Embodiments of the present invention relate generally to horizontally supported planar surfaces that may be vertically removable as a structural interlock for separable support and fastener components, and more particularly, to furniture such as knockdown desks and tables assembled from panels without the use of tools and without fasteners.

2. Description of the Related Art

Panel desks have become standard in the current office. Desks with vertical side and front panels in metal or wood visually define the vertical boundaries of the personal workspace as well as provide modesty protection. The vertical panels that create these visual boundaries generate both onsite assembly and functional problems.

Onsite assembly of panel desks vary between knockdown and ready-to-assemble approaches. At one extreme, knockdown desks made of panel materials are too heavy to be handled as a unit by a single assembler, and are too topologically complex to allow all panels to be interconnected with hinges. At the other extreme, ready-to-assemble panel desks are held together by fasteners that often fail structurally and usually require tools representing a test for the mechanically challenged. These are indicators for a fastener that is scaled to the structure, and a structure without fasteners, which is a contradiction in the prior art.

Functional problems with panel desks have emerged with the need for computer wiring and accessory management. Holes drilled in desk panels for wiring leave transformers, routers, power strips, and uninterrupted power supplies either on the desktop or lying beneath the desk.

Yet larger openings violate the nature of a panel desk. These are indicators for desk accessibility through the desk panels, which is a contradiction in the prior art. Further, a greater contradiction in the prior art is such accessibility through the desk panels of a knockdown panel desk.

Knockdown furniture may include furniture that may be field assembled from separate components without the use of tools and without onsite installed mechanical fasteners. Examples of mechanical fasteners may include threaded nuts, bolts, screws, hooks, and latches. In general, knockdown furniture may be constructed of panels and simple frames of wood and plastic that may be coated and reinforced by metals and composites.

Some ready-to-assemble panel furniture relies on slots or grooves to join independent wood MDF panels. The inherent drawback of slots and grooves it that they reduce the cross-section of the panel at exactly the point where more load-bearing capacity is required. In some ready-to-assemble furniture, the rigidity depends on positional restraints such as detents or notches to hold and restrain panels after assembly or fold-out. Such positional restrains enable easy assembly, but are structurally inadequate to bear the infrequent but substantial lateral loads imposed on furniture in the home or office by impact contact with users or when slid during furniture rearrangement. Such lateral loads create bending and flexing in the structure.

It will be understood by one skilled in the art that horizontal forces applied in the plane of the top surface from any direction describe a worst case scenario for ready-to-assemble and knockdown furniture. Knockdown furniture in the prior art is generally adequate for vertical loads on the top surface.

However, horizontal thrust loads in the plane of the top surface applied when the base is partly restrained prove these minimal positional restraints in the prior art to be inadequate in their nature compared to the scale of the furniture itself. For example, panel furniture with interlocking slots may only develop structural resistance for half its dimension since the other half is cut away. In a further example, a protrusion stop for a hinged leaf may be fitted into a panel notch that is less than 10% of the panel width.

The increase of computer accessories has greatly reduced usable desk space since most desks neither manage nor hide computer accessories or their wiring. Thus, another shortcoming with current ready-to-assemble and knockdown desks is their inability to provide internal storage for computer equipment and manage wiring.

BRIEF SUMMARY

An aspect of the present invention provides a positional restraint of a furniture piece that is scaled to a substantial portion of edges of the piece of furniture presented for quick and easy assembly. In an embodiment, the positional restraint due to the length of the contact between components of the piece of furniture varies from more than half to generally the width of a panel or component without material and strength loss due to cut-away slots or grooves.

Another aspect of the present invention provides an interlocking fastener that is a furniture (e.g., desk) structure.

Another aspect of the present invention provides a desk where the top surface is the removable fastener interlock.

Another aspect of the present invention provides a rigid structure able to resist substantial lateral and vertical loadings often experienced in furniture usage due to its interlocked nature of a fastener.

Another aspect of the present invention provides a desk that can be assembled without fasteners or tools by the use of components that sequentially secure the prior assembly steps.

Another aspect of the present invention provides a simple, rapid assembly sequence due to the few number of components and absence of fasteners.

Another aspect of the present invention provides a desk structure that can be shipped in a standard container due to the hinged components.

Another aspect of the present invention provides a computer equipment housing due to an internal shelf.

Another aspect of the present invention provides both wire management and computer equipment support within the same housing that is positioned internal to the desk.

Another aspect of the present invention provides a wire and cable management system due to access to the equipment housing from both the top and front of the desk.

In accordance with an aspect of the present invention, a multiple member fastener and furniture structure is provided. The multiple member fastener and furniture structure may include a horizontal diaphragm member; a vertically removable top surface and keeper member; and two opposing vertically hinged support gate members closed around and vertically clamping opposing ends of the horizontal diaphragm member beneath the vertically removable top surface and keeper member. The vertically removable top surface and keeper member may be supported by and positioned to keep closed and clamped said two opposing vertically hinged support gate members.

The foregoing and other aspects will become apparent from the following detailed description when considered in conjunction with the accompanying drawing figures.

DETAILED DESCRIPTION

Figure 1:
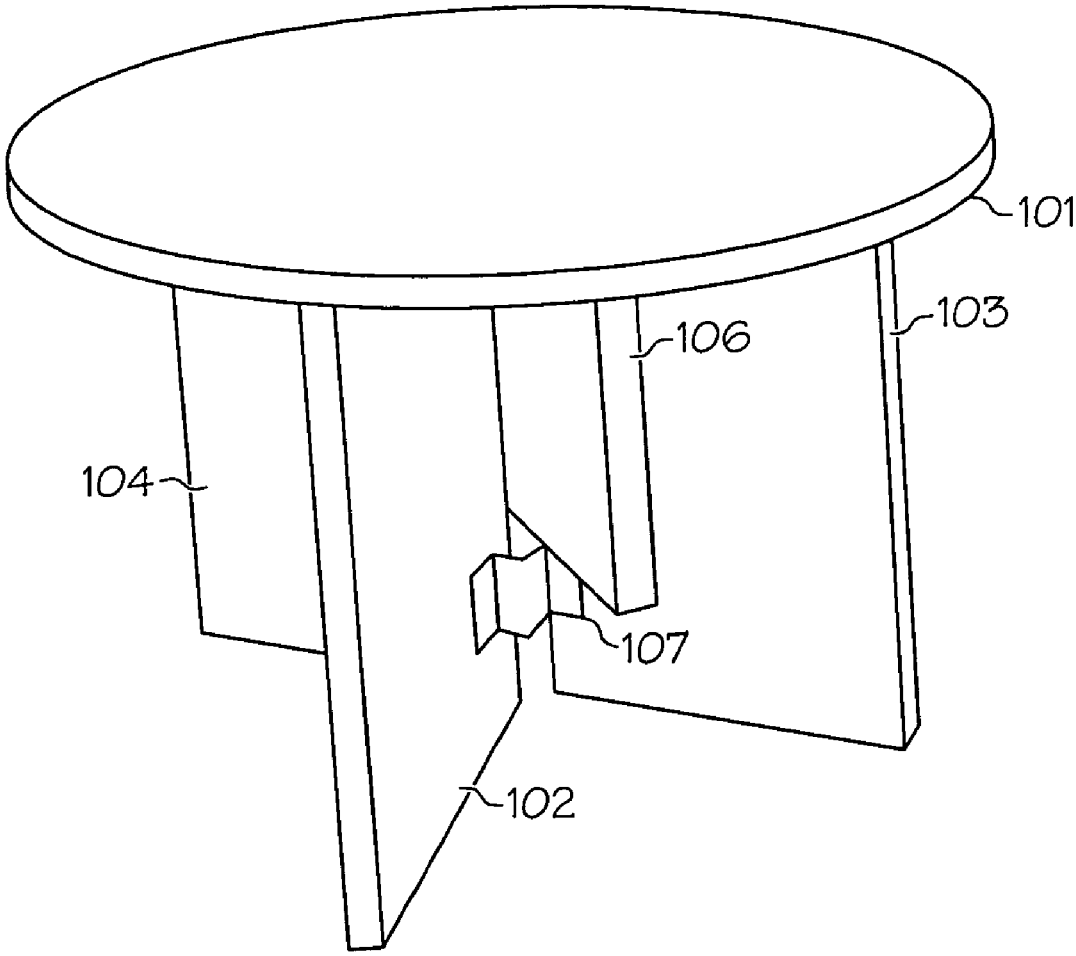
FIG. 1 is a perspective view of a generally circular piece of furniture (e.g., a desk or table) according to an embodiment of the present invention.

Reference will now be made in detail to embodiments of the present invention, examples of which are illustrated in the accompanying drawings, wherein like reference numerals refer to the like elements throughout. The embodiments are described below to explain the present invention by referring to the figures.

As used in this application, the terms "a", "an" and "the" may refer to one or more than one of an item. The terms "and" and "or" may be used in the conjunctive or disjunctive sense and will generally be understood to be equivalent to "and/or". For brevity and clarity, a particular quantity of an item may be described or shown while the actual quantity of the item may differ.

Embodiments of the present invention may include furniture such as knockdown desks and tables assembled from panels without the use of tools and without fasteners in which the support and lateral force resisting structure may be the fastener. The fastener may be a hinged support gate clamping a second member with a third detachable top surface member completing and securing the interlock with result of producing a computer wiring and accessory management device, system, and method by providing access for generally the length of the front, back, and top of a panel furniture piece (e.g., desk). Embodiments of the present invention may include a ready-to-assemble cabinet structure for setup as a robust computer desk, table, kneehole bench, or framed trestle including foldable sides that may clamp ends of a lateral diaphragm brace that supports an externally accessible internal housing for computer equipment and wiring management that is shipped in compact form to a remote site, for assembly without fasteners or tools and the method of assembly.

In order to overcome the deficiencies of the prior art and contradictions in the conventional wisdom of the furniture industry, an embodiment of the present invention may include a fastener that may be scaled as a desk or table including four structural components including at least two vertically hinged support gates that may clamp both opposing faces of two ends of a third transverse member beneath a fourth detachable and vertically removable top surface member completing and securing the interlock with horizontal compressive restrain on the same side of the upper faces of the two vertically hinged support gates as the pivot point of their hinges.

An embodiment of the present invention may include a symmetrical, rigid, freestanding furniture structure where vertically-foldable opposite support sides may be rigidly connected by a vertical beam and diaphragm with end fixtures that may be secured by the hinged clamping action of the foldable supports sides where the centers of pivot may be offset out-of-plane of the leafs providing a vertical aperture when the hinge may be open for insertion of the end fixtures that may be griped and clamped, and may be then blocked in the closed, clamped position at the outer edges of the leaf extension in this gripped state by one or more top horizontal planar members supported by the diaphragm and generally acting against the leafs with a perpendicular force as a chock and keeper.

Aspects of the present invention may be embedded in a hinged support structure and diaphragm clamp that may be securely horizontally blocked, restrained, and chocked by downward turned edges of a top surface in direct contact with top face of the hinged support structure. A chock may include a block or member element that may be selected to restrain a movable member. Aspects of the present invention may include (1) a horizontal structural member that may be clamped at ninety degrees to the hinged opposing faces of a clamp, (2) the opposing faces of a hinged clamp may be selected to be spaced apart to allow for the thickness of the cross brace member, (3) the hinged panels may achieve a stable open position during assembly and insertion of the cross brace member, (4) the hinge pivot may be offset by a selected distance to enable the member to be easily inserted prior to the closing of the opposing faces of the hinge, (5) the clamping members may be the supporting assembly structure for a utility and load bearing top surface, (6) the downward turned edges of the top surfaces may chock or jam the clamps in a closed and restraining position to form a (7) rigid structure for resistance to vertical loads on the top surface and substantial horizontal loads applied generally at the plane of the top surface, and (8) the resulting omni-directional access to the interior of the panel structure without compromising structural integrity provide a unique PC wiring and accessory management system.

A furniture structure is disclosed where the distinctions of a top surface are (1) a supported horizontal planar surface, (2) supported by hinged folding supports, panels, or frames, that clamp securely lateral cross braces or side-sway resistant diaphragm, (3) vertically removable, (4) horizontally adjustable, (5) embraces folding supports with downward extending faced edges at ends, and (6) direct and forceful frictional keeper contact for maintenance of position in relation to supports without fasteners.

FIG. 1 is a perspective view of a generally circular piece of furniture (e.g., a desk or table) according to an embodiment of the present invention. FIG. 1 shows a top surface 101 supported by a base including support panels 102 and 103 connected by hinge 107 which may clamp diaphragm 106. An opposite assembly is indicated by support leaf and panel 104 and is further detailed in FIGS. 2*a*-2*c*.

Figure 2A:
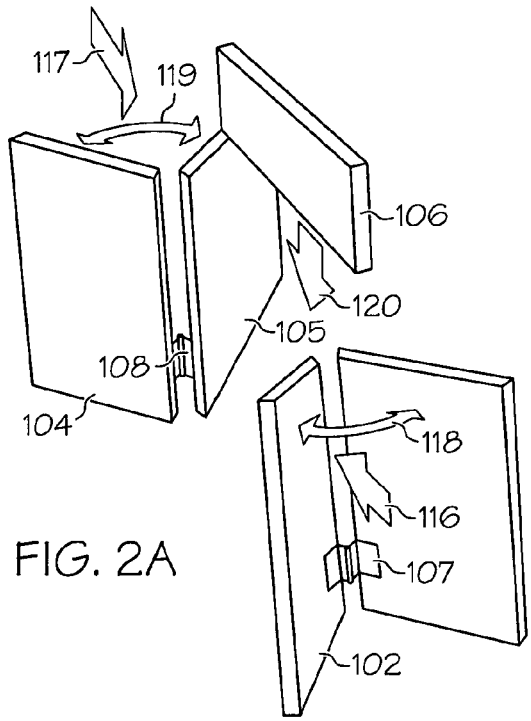
FIG. 2*a* is a perspective view of the assembly features of a base of the piece of furniture of FIG. 1.

FIG. 2*a* is a perspective view of the assembly features of a base of the piece of furniture of FIG. 1. FIG. 2*a* shows that support panel 102 and support panel 103 may be extended leaves of hinge 107. Likewise, support panel 104 and support panel 105 may be extended leaves of hinge 108. Diaphragm 106 is shown in a position above and centered between hinges 107 and 108. Arrows 116, 117 indicate that the two hinged assemblies 102, 103 and 104, 105 may be brought together and diaphragm 106, as indicated by arrow 120, may be lowered into position within the created opening. Arrows 118, 119 indicate that hinged leaves 102, 103, and 104, 105 may be closed so as to clamp diaphragm 106. The hinged gate assemblies may include butt type hinges that when in the closed and clamped position may have their primary leaves parallel.

Figure 2B:
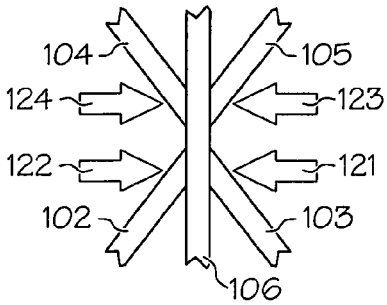
FIG. 2*b* is a partial top view of the base of the piece of furniture of FIG. 1 after assembly.

FIG. 2*b* is a partial top view of the base of the piece of furniture of FIG. 1 after assembly. FIG. 2*b* shows the closed and clamped forces generated by support panel 102 and support panel 103 on diaphragm 106 indicated by arrows 121, 122. Likewise, the closed clamping action of support leaves 104, 105, when closed, generates forces indicated by arrows 123, 124 to clamp and secure diaphragm 106. The closed position of the hinges 107, 108 may provide a gap between vertical opposing inside faces of support panels 104, 105, and 102, 103 to accommodate the clamped and compressed thickness of diaphragm 106.

Figure 2C:
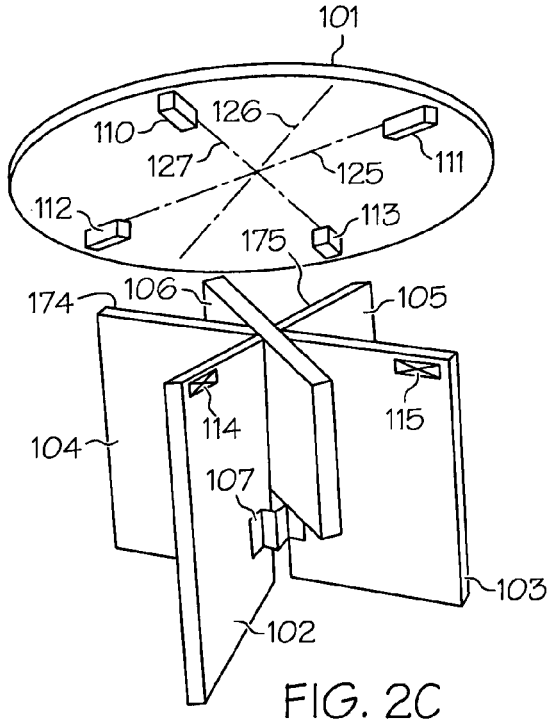
FIG. 2*c* is a perspective view of the assembly features of the base of the piece of furniture of FIG. 1.

FIG. 2*c* is a perspective view of the assembly features of the base of the piece of furniture of FIG. 1. FIG. 2*c* shows the assembled support base wherein support panels 102, 103, 104, 105 may be clamping and securing diaphragm 106. Hinge 107 is shown foldably connecting support panels 102, 103. Desktop surface 101 comprises retaining blocks including faces 110, 111, 112, 113 being down-turned edges of top surface 101. Projected centerline 126 represents the assembled position of diaphragm 106. Guide line 125 represents generally the alignment of support leaves 103, 104 after the top 101 is lowered into its removable place. Guide line 127 indicates generally the final assembled position of support panels 102, 105. Support panel 102 may include a pressure area 114 on the upper outside corner where force from the down-turned face 110 may act as a keeper to secure and restrain support leaf 102 in its clamped position on diaphragm 106. Likewise, support panel 103 may have a pressure area 115 where a restraining force may be supplied by a face of a block keeper 111 to restrain and secure clamping action on diaphragm 106. Likewise pressure areas 174, 175 on support leaves 104, 105 by block faces as keepers 112, 113 may secure and restrain support panels 104, 105 in their locked and clamped position.

Figure 3:
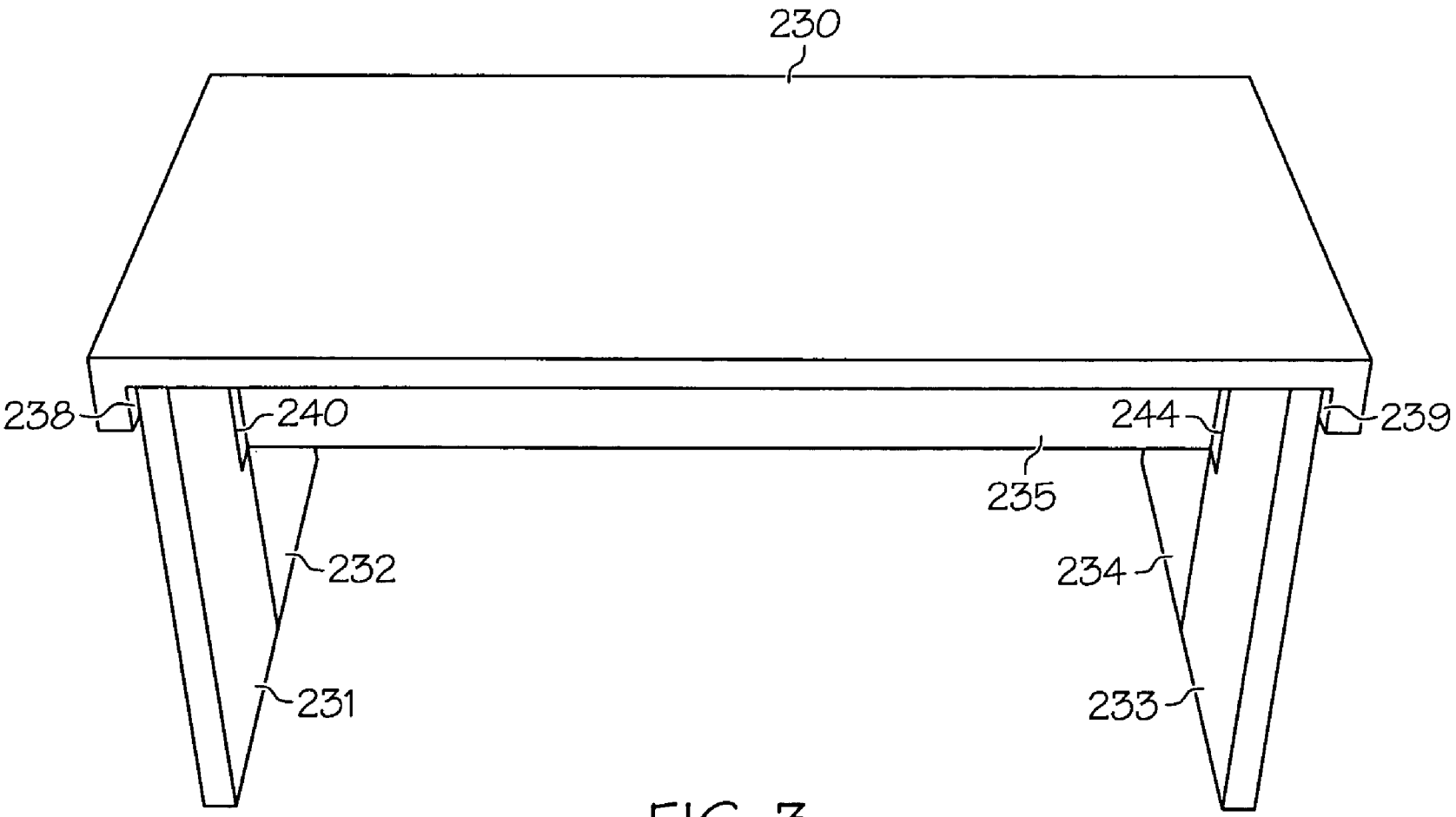
FIG. 3 is a perspective view of an assembled piece of furniture (e.g., a desk) according to another embodiment of the present invention.

FIG. 3 is a perspective view of an assembled piece of furniture (e.g., a desk) according to another embodiment of the present invention. The inside face of a down-turned edge of the top surface 230 may lock and secure the extended leaves of a hinged support assembly where the pivot point of the hinges may be external to the general desk structure. According to an embodiment of the present invention, locking and securing of the desk structure may be most efficiently provided by restraint on the opposing contact surfaces of the extended leaf structures perpendicular to and as far from the pivot axis of the hinge as possible. According to an embodiment of the present invention, the locking force of the down-turned edge of the top surface 230 may be applied on the same side of a hinge as the pivot axis of that hinge or hinges.

In the embodiment of FIG. 3 (shown assembled), the vertical hinge pivot axis may be external to the general structure of the desk. In FIG. 3, the top surface 230 of the desk may include down-turned edges 238, 239, and may be supported by panels 231, 232, 233, 234, and diaphragm 235. A down-turned edge may include any vertical face integral or attached to the top surface 230 facing inward or outward from the general structure of the top surface 230 where the vertical height of this face may be a small portion of the width or length of the top surface. FIG. 3 shows diaphragm 235 possessing end fixtures 240, 244 that may serve as positional restraints. Other end fixtures and diaphragm appurtenances may include tenons, tracks, runners, and guides to assure correct and fixed relationship between the diaphragm 235 and the closed support panels 231-234. In addition, the fixtures 240, 244 may include a constrictable grip which may provide positional restraint due to its deformation under the clamping forces sufficient to maintain positional relationships. Such constrictable grips may have the advantage of eliminating a need for shaping the outside legs of tenons, tracks, runners and guides to conform to the radial entry of the mating surfaces of the supports.

Figure 4:
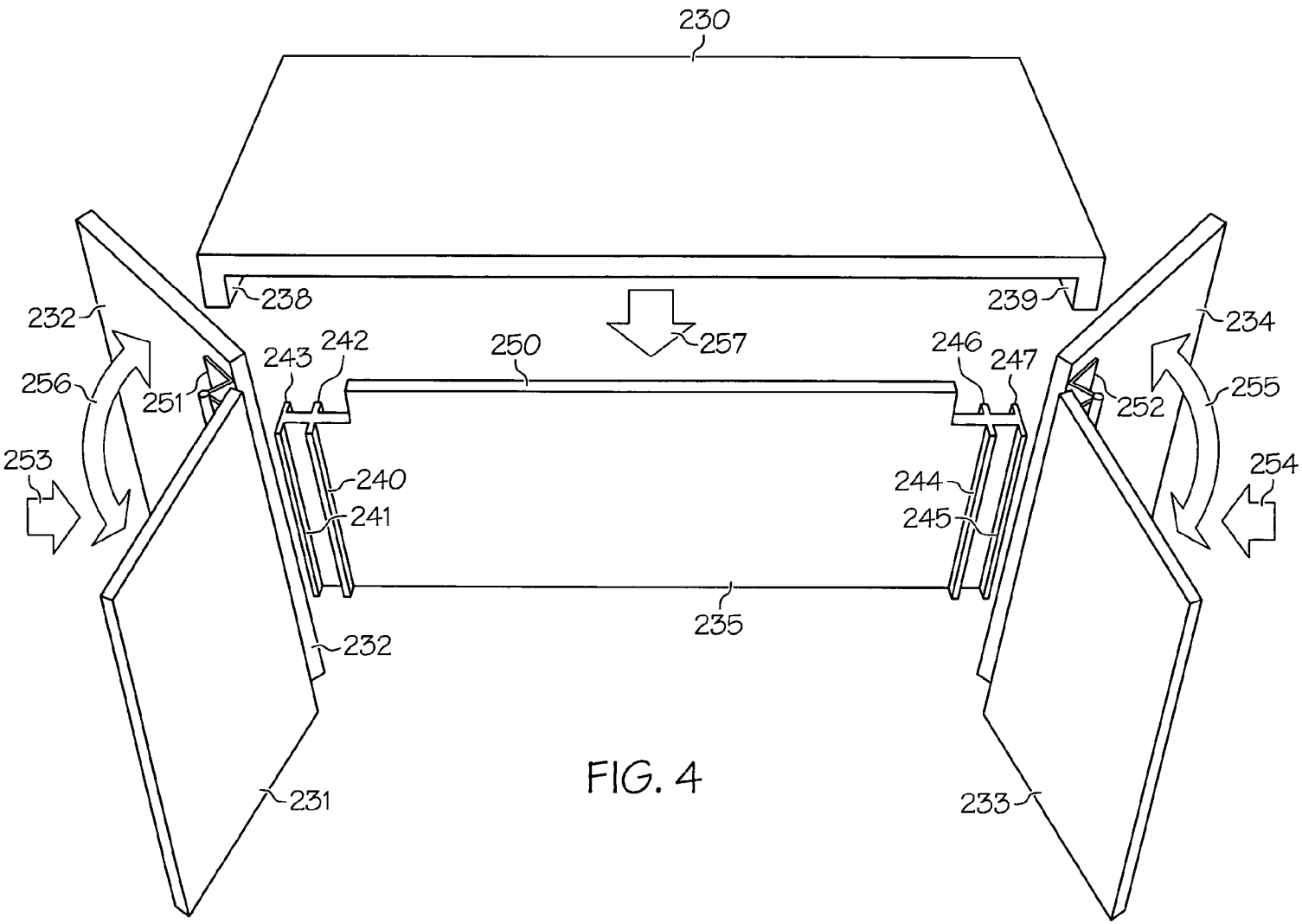
FIG. 4 is a perspective view of the assembly of the components of the piece of furniture of FIG. 3.

FIG. 4 is a perspective view of the assembly of the components of the piece of furniture of FIG. 3. On the left of FIG. 4, a hinged assembly may include support panels 231, 232 connected by at least one hinge 251. Likewise, on the right, a hinged assembly may include support panels 233, 234, connected by at least one hinge 252. In the center, diaphragm 235 may posses interior guide fixtures 240, 242, 244, 246 that may guide and secure position on the interior edges of panels 231, 232, 233, 234 at the folds. Likewise exterior guide fixtures 241, 243, 245, 47 may guide and secure position on the exterior edges of panels 231, 232, 233, 234 at the folds. A top surface 250 of diaphragm 235 may be available for longitudinal support on the centerline beneath top surface 230. It will be noted that the upper corners of diaphragm 235 may be cut away to clear hinges 251, 252 so that top diaphragm surface 250 may support the underside of top surface 230 after assembly. To assemble, arrows 253, 254 indicate that the left and right assemblies may be moved inward and the hinges closed as indicated by arrows 255, 256 whereby the opposing faces of the support panels 231, 232, 233, and 234 may engage and may be positively restrained within the guide fixtures 240-247. Arrow 257 indicates that top 230 may then be lowered with the result that down-turned edges 238, 239 may engage outmost upper external vertical faces of panels 231-234 to restrain and securely lock the assembly as a single fastened structure without the use or need for tools.

Figure 5A:
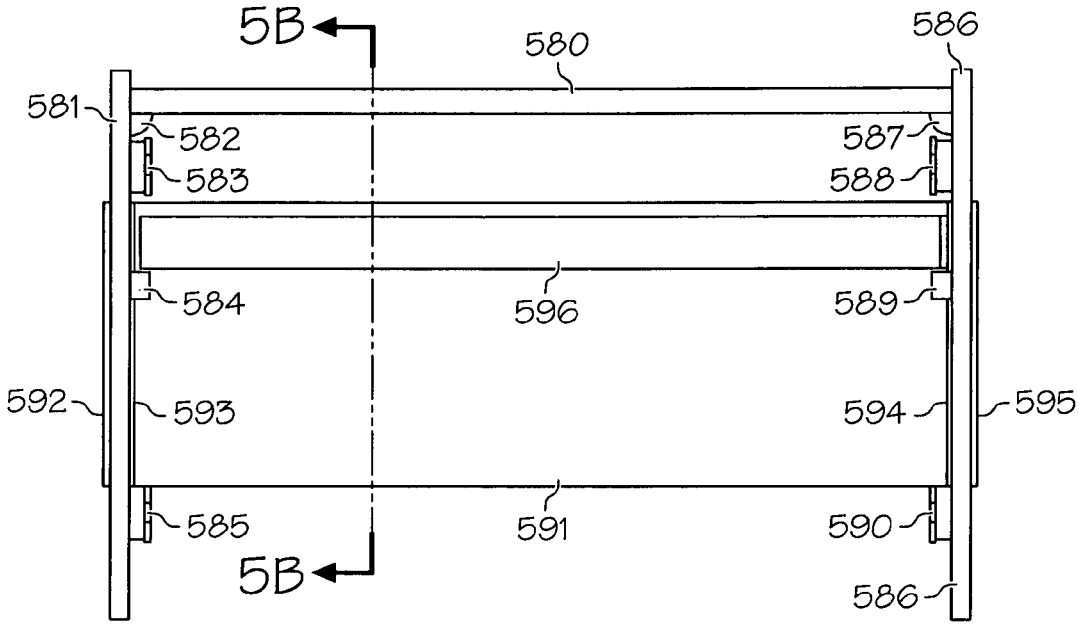
FIG. 5*a* is an elevational view of a piece of furniture according to an embodiment of the present invention.

FIG. 5*a* is an elevational view of a piece of furniture according to an embodiment of the present invention. FIGS. 5*b*-5*e* are sectional views of the piece of furniture of FIG. 5*a*. FIGS. 5*a*-5*e* show an embodiment of the current invention in which the hinging function may be divided between an upper and lower hinge on each support assembly. All potential lateral forces that may tend to deform the structure in side-sway may be resisted by the vertical diaphragm that may act as a cross brace between the structures. According to an embodiment of the present invention, maximizing the distance between hinges and positioning them above and below a vertical diaphragm may maximize the resistance to side-sway of a four member structure that may also be a standalone fastener requiring no tools for assembly or knockdown.

FIG. 5*a* shows the desk including a top surface 580, support panels 581, 586, diaphragm 591, and shelf 596. Support panel 581 may include bearing strip 582, hinges 583, 585, and shelf bracket 584. Likewise support panel 586 may include bearing strip 587, hinges 588, 590, and shelf bracket 589. Diaphragm 591 may include grip fixtures 592-595. Top surface 580 may bear on and be supported by bearing strips 582, 587, and in turn, may include down-turned edges which may bear against support panels 581, 586. Diaphragm 591 may be supported by hinges 585, 590. Support 581 may engage grip fixtures 592, 593. Likewise, support panel 586 may engage grip fixtures 594, 595. Shelf 596 may be supported by shelf brackets 584, 589.

Figure 5B:
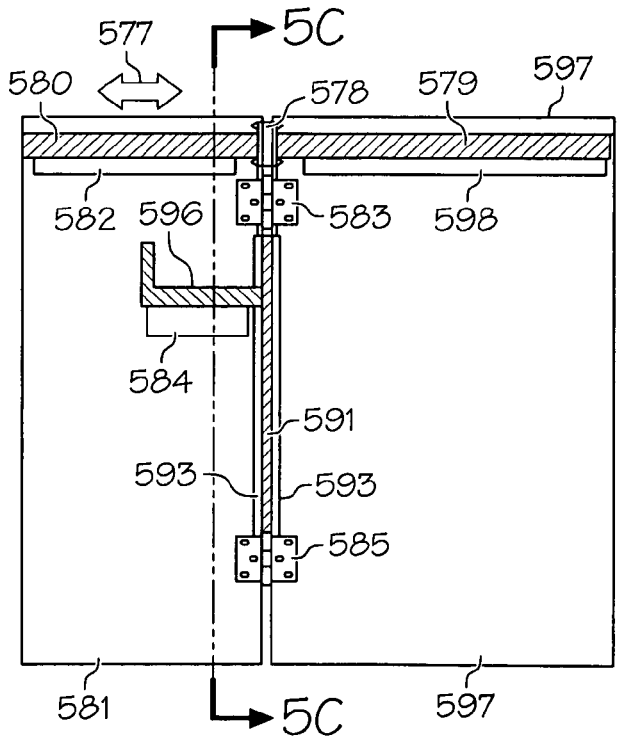
FIGS. 5*b* to 5*e* are sectional views of the piece of furniture of FIG. 5*a*.

FIG. 5*b* a vertical section view through the desk of FIG. 5*a* showing that the hinged support panels 581, 597 may be different widths to provide enlarged knee space for a seated individual. A hinged assembly is shown and may comprise support panels 581, 597, which may include bearing strips 582, 598, hinges 583, 585, and shelf bracket 584. Diaphragm 591 may include grip fixture 593. Top surfaces 579, 580 may be supported by bearing strips 582, 598 respectively. The hinged assembly of support panels 581, 597 may engage and may be secured by grip fixture 593. The top surfaces 579, 580 are shown in an adjacent and closed position yet may include a gap between their interior faces filled with a narrow resilient strip attached to the vertical interior face of either top surface 579, 580 to conform to and accommodate wiring rising from shelf 596 without allowing small objects to fall through.

In FIG. 5*b*, shelf 596 is shown and may include an upturned exterior edge and in close proximity to diaphragm 591, thus forming a trough. Top surface 580 is shown by double headed arrow 577 to be capable of sliding to the front and return to allow temporary access to shelf 596 interior of the desk for the entire length of shelf 596. The sliding action of the top surface 580 may continue to produce a securing force on opposing support panels 581, 586 as it slides forward with the result that the structural integrity of the desk may not be compromised while providing interior access to the desk and interior shelves through the enlarged open space at gap 578. The five member knockdown panel desk comprising a diaphragm clamped at its opposite ends by two opposing hinged panel supports secured in the closed and clamped position as a keeper by two coplanar top surface members also may result in a computer wiring and accessory management device, system, and method by providing access from generally the length of the front, back, and top of the desk.

Figure 5C:
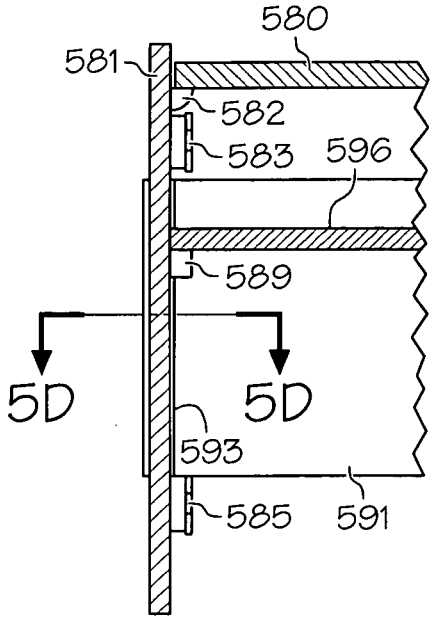

FIG. 5*c* is a vertical section view through the desk of FIG. 5*b*. Support panel 581 may include bearing stop 582, hinges 583, 585, and shelf bracket 589. Diaphragm 591 may include grip fixtures 592, 593. Top surface 580 may be supported by bearing strip 582. Diaphragm 591 may be supported by hinge 585 during assembly and include grip fixtures 592, 593, which are shown engaging support panel 581.

Figure 5D:
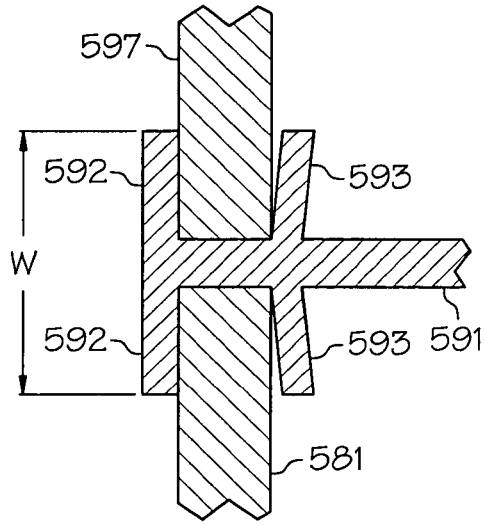

FIG. 5*d* is an enlarged horizontal section view of FIG. 5*c*. Diaphragm 591 is shown engaging support panels 581, 597 with grip fixtures 592, 593. Grip fixture 593 is shown to be bent slightly to accommodate the radial entrance of support panels 581, 597 as their hinges may be closed so that the opposing vertical faces of support panels 581, 597 may supply secure restraint to the diaphragm action of diaphragm 591 as transverse horizontal loadings may be experienced by the desk at its top surface. Dimension W may be accommodated when panels 581, 597 are hinged open.

Figure 5E:
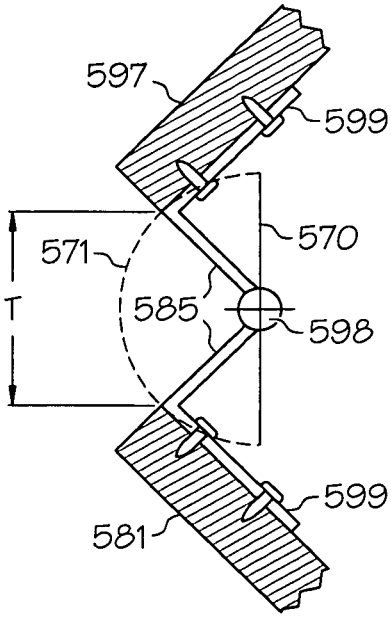

FIG. 5*e* is an enlarged section view showing how the offset hinge 585 may accommodate the width W shown in FIG. 5*d*. In FIG. 5*e*, the hinge 585 may have a pivot 598 and two L-shaped leaves that are attached by screws 599 to support panels 581, 597. The support panels 581, 597 are shown oriented at approximately a 90 degree angle. According to an embodiment, a generally right angle may be optimum for resting the hinged assembly of support panels 581, 597 on a horizontal surface during assembly operations to prevent the assembly from toppling over. Since hinge support assembly of support panels 581, 597 may posses an upper hinge 583 and a lower hinge 585, it follows that the end appurtenances such as grip fixtures 592, 593 may be inserted through the hinged opening during assembly. The clearance throat dimension is indicated by dimension T. Therefore, for facile instillation, the hinged opening T may be selected to accommodate the end appurtenances of diaphragm 591 for insertion in the opening between the hinged vertical interior faces of support panels 581, 597 as they rest open at a stable angle on a horizontal surface such as the floor.

Additionally FIG. 5*e* depicts two hinged support panels 581, 597. The butt type hinged connections between support panels 581, 597 may comprise a vertical pintle or pivot axis 598, plate leaves 585, and L-shaped right angle leaf extension 599 shown securely attached with screws or other means. The primary hinge leaves 585 are shown in a partly open or generally right angle position as described above. When closed, the leaves 585 of the hinge may be parallel which may be the common understanding of a butt hinge. Since the hinged assembly of support panels 581, 597 may be a vice or clamp in their closed position, the leaves 585 may not nest or contact in the closed position. Arc 571 depicts the swing of the vertical opposing inside faces of support panel 581, 597. Arc terminal line 570 may depict the limit of travel of leaves 585 when the support panels 581, 597 may be parallel in the fully open position for compact shipping and storage. In common usage, the leaves of a butt hinge 585 may be straight without angled extensions 599 and may be connected into the vertical opposing edge faces of panels 581, 597. However, to increase the strength of the connection of the hinge 585 to panels 581, 597, a right angle leg 599 may be added to each butt hinge leaf 581, 597 to increase the connection area and lower the stress by the use of multiple fasteners.

Figure 6A:
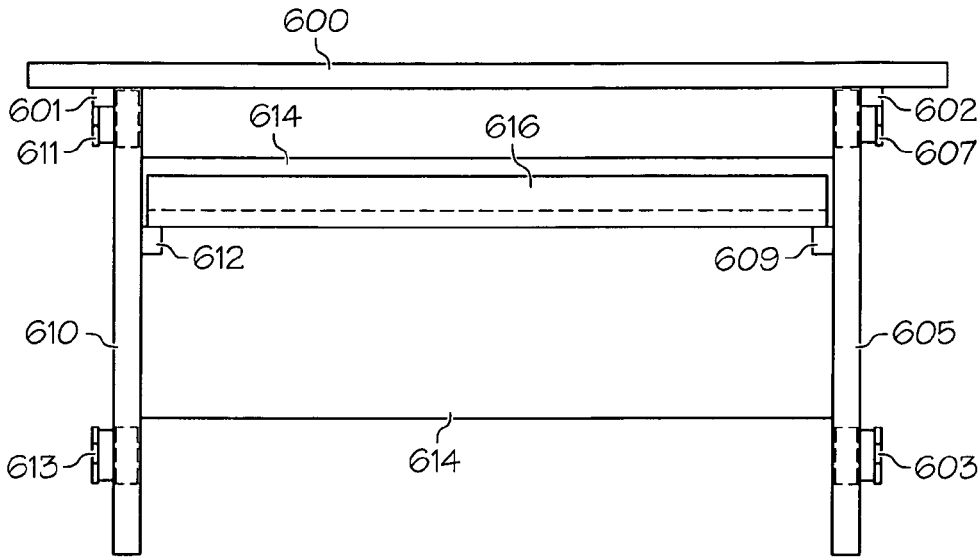
FIGS. 6*a* and 6*b* are elevational views of a piece of furniture (e.g., a desk) according to an embodiment of the present invention.
Figure 6B:
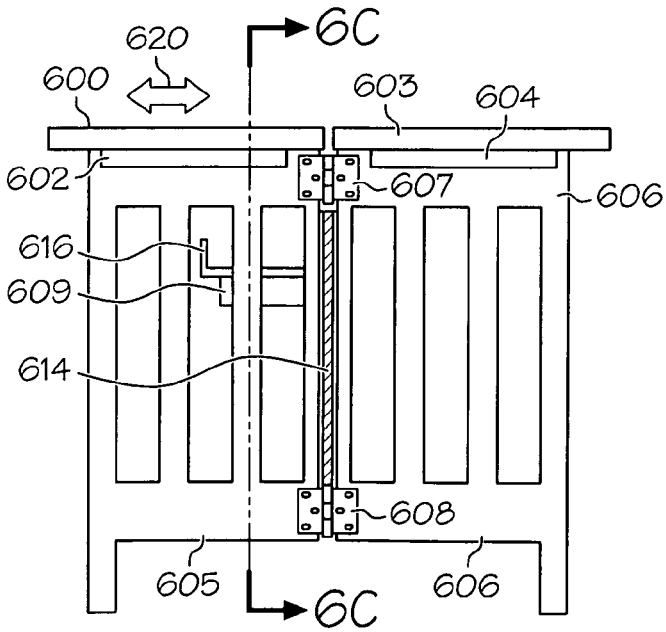

FIGS. 6*a* and 6*b* are elevational views of a piece of furniture (e.g., a desk) according to an embodiment of the present invention. FIG. 6*a* shows the front elevation of the desk including a top surface 600, support frames 610, 605, diaphragm 614, and shelf 616. Shelf 616 may include an upturned lip that may form a wiring and equipment trough. Top surface 600 may include down-turned edge blocks 601, 602. Support frame 610 may include hinges 611, 613, and shelf bracket 612. Likewise support frame 605 may include hinges 607, 608, and shelf bracket 609. Top surface 600 may bear on and be supported by support frames 610, 605, and in turn, include down-turned edges represented by blocks 601, 602 which may bear against outside faces of support frames 605, 610. These blocks 601, 602 may be locking devices restraining the hinged supports 610, 605 in clamped position about the ends of the vertical diaphragm 614. Diaphragm 614 may be supported by hinges 608, 613. This support by the hinges 608 and 613 may aid in correct positioning of diaphragm 614 in relationship to support frames 610, 605 during assembly prior to clamping. Shelf 616 may be supported by shelf brackets 609, 612.

FIG. 6*b* is an end view of the desk of FIG. 6*a*. A hinged assembly is shown and may comprise support frames 605, 606, hinges 607, 608, and shelf bracket 609. Top surface 600 may include down-turned edge block 602 that may act as a keeper to restrain the support frame 605 in a closed position clamping diaphragm 614 while being supported by support frame 605. Likewise, top surface 603 may include down-turned edge block 604 that may act as a keeper to restrain the support frame 606 in a closed position clamping diaphragm 614 while being supported by support frame 605.

The base or bottom of a wiring and equipment trough may be formed by shelf 616 that is shown supported by shelf bracket 609. The sides of the trough may be formed by the upturned lip of removable shelf 616 and the vertical face of diaphragm 614 which may be abutted by the inward horizontal edge of shelf 616. It will be understood by one skilled in the art that shelf 116 may also be supported by other means including by way of non-limiting example bearing brackets attached to diaphragm 614. Access to the wiring and equipment trough may be afforded from the sides through openings in support frame 605, from the front between the upturned lip of shelf 616, from the back between the top lip of diaphragm 614 and the underside of top surface 600, and from above by sliding top surface 600 forward to open up the slot between top surface 600 and top surface 603 as indicated by arrow 620. Upon the return of the top surface 600 to its original position as shown as indicated by arrow 620, the slot may be utilized for wiring communication to the top surfaces 600, 603 from shelf 616.

Figure 6C:
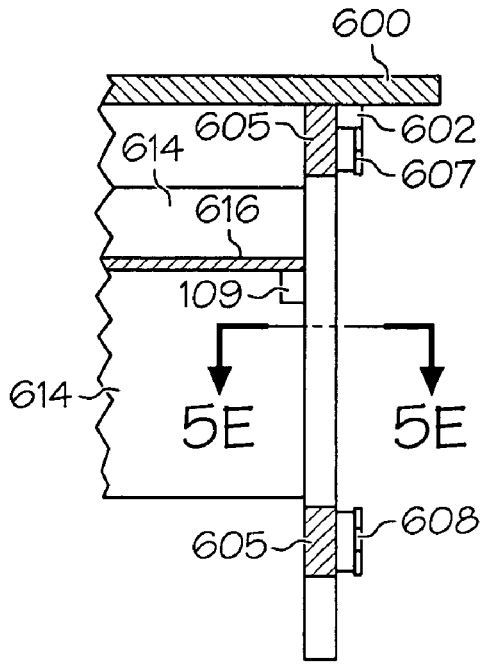
FIGS. 6*c* and 6*d* are sectional views of the piece of furniture of FIGS. 6*a* and 6*b*.

FIG. 6*c* is a vertical section view through the desk of FIG. 6*b*. Support frame 605 may include hinges 607, 608, and shelf bracket 609. Top surface 600 may be supported by support frame 605. Block 602 may be secured to top 600 whereby it may act as a down-turned edge of top surface 600 to restrain support frame 605 in a locked position clamping diaphragm 614. Diaphragm may be positioned to be supported by hinge 608 to facilitate erection during assembly.

Figure 6D:
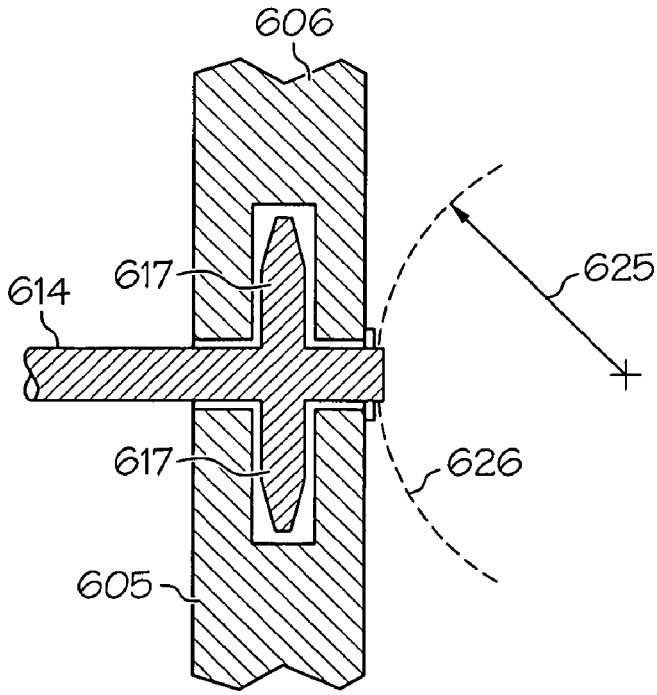

FIG. 6*d* is an enlarged horizontal section view of FIG. 6*c*. Diaphragm 614 is shown engaging support frames 610, 605 with feather tenons 617 that may be generally the length of the vertical side of diaphragm 614. Feather tenons 617 are shown to and may be shaped to accommodate the radial entrance of support frames 610, 605 as their hinges may be closed and the tenons 617 may be inserted. The hinged effect on the support frames is shown as the hinged turning radius 625 may generate the circular arc 626. The tenons may prevent clamping slippage and assure a fixed positional relationship between the support frames 610, 605 and diaphragm 614 after closure and clamping. These feathered or shaped tenons 617 may restrain the opposing vertical faces of support frames 610 and 605 to supply secure restraint to the side-thrust, side-sway, and bending action of diaphragm 614 as transverse horizontal loadings may be experienced by the desk at its top surface or sides. Dimension W may be accommodated when frames 610, 606 are hinged open since the uppermost hinge 611, 607 shown in FIG. 6*a* may prevent the diaphragm 114 from being inserted vertically into its position as shown in FIG. 6*d*.

Figure 7:
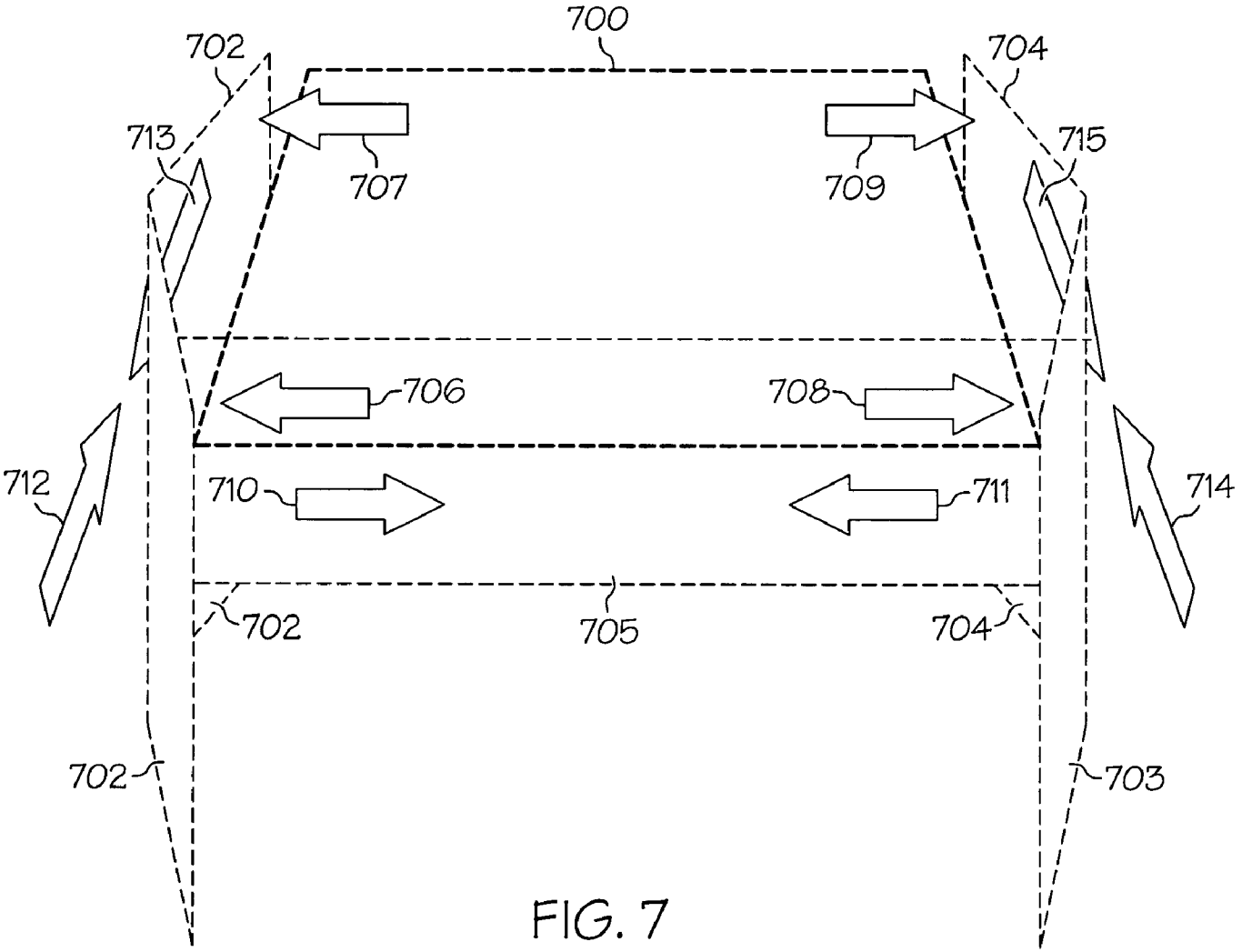
FIG. 7 is a schematic representation of force vectors projected upon a duplex fastener and piece of furniture with hinge pivots internal to the piece of furniture in accordance with an embodiment of the present invention.

FIG. 7 is a schematic representation of force vectors projected upon a duplex fastener and piece of furniture with hinge pivots internal to the piece of furniture in accordance with an embodiment of the present invention. FIG. 7 shows the balance force vectors that may keep the duplex fastener closed and give the structure rigidity. Duplex fastener may include two separate assemblies latched, kept closed, and rigid by a single removable element.

In FIG. 7 the phantom perspective shows a vertical diaphragm 705 beneath a horizontal planar top 700 that may span the longitudinal space between and connect two opposing hinged assemblies shown partly open on the right and left for illustrative purposes. On the right, a hinged assembly may comprise panel leaf 703 and panel leaf 704 that may be connected by hinges which may include a common vertical pivot axis that is internal to the structure. This hinged assembly may clamp the right end of diaphragm 705. On the left a hinged assembly may comprise panel leafs 701, 702 that may be connected by hinges that may include a common vertical pivot axis that is internal to the structure. Likewise this hinged assembly may clamp the left end of diaphragm 705.

In FIG. 7, the force schematic shows opposing force arrows 710, 711 as forces internal to diaphragm 705 illustrating the tension that may issue from the two opposing hinged assemblies 701, 702, and 703, 704. The top 700 is in compression as shown by opposing force arrows 706 and 708 on the front and 707, 709 on the back edges due to the resistance of the hinged assemblies to rotate to their fully closed position to clamp diaphragm 705.

On the left, the combined horizontal forces represented by force arrows 206, 207 may be opposed and balanced by force arrow 710 representing tension in diaphragm 705. Force arrow 706 of the top 700 is shown contacting and acting on leaf 701 near the upper outer edge. Because of the lever arm of the horizontal width of panel leaf 701, the force 706 may be multiplied and result in a large clamping force vector indicated by force arrow 712. Likewise, force arrow 707 of the top 700 is shown contacting and acting on leaf 702 near the upper outer edge. Because of the lever arm of the horizontal width of panel leaf 702, the force 707 may be multiplied and result in a large clamping force vector indicated by force arrow 713. These large clamping force vectors 712, 713 may act on opposing faces of diaphragm 705 and due to frictional and other restraining appurtances, may prevent horizontal positional movement between diaphragm 705 and panel leaves 701, 702.

In like manner, on the right, the combined horizontal forces represented by force arrows 708, 709 may be opposed and balanced by force arrow 711 representing tension in diaphragm 705. Force arrow 708 of the top 700 is shown contacting and acting on leaf 703 near the upper outer edge. Because of the lever arm of the horizontal width of panel leaf 703, the force 208 may be multiplied and result in a large clamping force vector indicated by force arrow 714. Likewise, force arrow 709 of the top 700 is shown contacting and acting on leaf 704 near the upper outer edge. Because of the lever arm of the horizontal width of panel leaf 704, the force 709 may be multiplied and result in a large clamping force vector indicated by force arrow 715. These large clamping force vectors 714, 715 may act on opposing faces of diaphragm 705 and due to frictional and other restraining appurtances, may prevent horizontal positional movement between diaphragm 705 and panel leaves 703, 704.

According to an embodiment of the present invention, as a duplex force active fastener, a horizontally positioned vertical tension plate whose two ends may be compressively clamped by two assemblies of butt-hinged plates that may be compressed at the lever arm of their outward upper corners so as to create the maximum bending-moment by a compressive horizontal top plate which may result in the maximum degree of structural rigidity against horizontal loads in the plane of the horizontally positioned vertical tension plate.

According to an embodiment of the present invention, as a symmetrical duplex fastener, each side may compress a compressive member receiving compression from the opposing end of the other side of said fastener to apply two generally equal widely separated compressive forces to the extended leaves of a butt hinge thereby enlarging that compressive force to securely clamp one end of a tension member communicating tension to the opposing end of said tension member as a component of the other side of said fastener.

According to an embodiment of the present invention, a method of assembling a four member table structure may be provided. The method may include: while floor supported, unfolding each of two vertically hinged support gate members through a generally 90 degree horizontal angle; spaceing and positioning apart each of said two opposing vertically hinged support gate members generally the length of the horizontal diaphragm member; examining the top surface member to determine whether the orientation of the down-turned edge faces of opposing ends are interior or exterior to said top surface member; rotating each of said two opposing vertically hinged support gate members until their hinges are interior to the center of said horizontal diaphragm member if the orientation of the down-turned edges of said top surface are interior to said top surface, or rotating each of said two opposing vertically hinged support gate members until their until their hinges are exterior to the center of said horizontal diaphragm member if the orientation of the down-turned edges of said top surface are exterior to said top surface; inserting the ends of said horizontal diaphragm member through the space between the opposing hinged vertical faces of each of the two vertically hinged support gate members; folding closed each of said two vertically hinged support gate members to clamp and secure the two opposing ends of said horizontal diaphragm member; and vertically lowering the top surface member so that said down-turned edge faces abut, pressure, and secure as keepers said opposing two vertically hinged support gate members in a closed and clamped position.

Distinctions of embodiments of the present invention may be that both hinged leaves of both side support gates may be chocked and held in secured position by both sections of the top surface and both sections of the top surface may pivot upward without being hinged. Because the top surfaces may not be hinged but slide and pivot, they may create access to the desk interior. In addition, the two faces of the desk may allow knee space for workers from both sides of the desk. Structurally, embodiments of the present invention may be most stable at the outside vertical edge of the desk's gate supports because the chock provision of the top may provide the greatest restraining force as a compressive jam on that outside vertical edge of the gate leaf. The gate supports may not be constrained by the weight of the top but by the chocking action of the top.

Although embodiments of the present invention have been shown and described, it would be appreciated by those skilled in the art that changes may be made in these embodiments without departing from the principles and spirit of the invention, the scope of which is defined in the claims and their equivalents.

The invention claimed is:

1. A knockdown desk comprising a diaphragm including a top, a bottom, ends, and vertical faces;

at least two supports, each including a top, a bottom, edges, and two hingedly-connected panels defining vertical opposing faces; and at least one top surface including a front, a back, sides, and two down-turned edges, said at least one top surface being supported by the at least two supports, where said vertical faces of said diaphragm are clamped by said two hingedly-connected panels of said at least two supports when said two hingedly-connected panels are in a closed position in which each of the two hingedly-connected panels align with one-another thereby defining a substantially single vertical plane, where said diaphragm is removable from said at least two supports when said two hingedly-connected panels are in an open position in which said two hingedly-connected panels are at an obtuse angle relative to each other, where said two down-turned edges of said at least one top surface restrain said at least two supports when said two hingedly-connected panels are in the closed position, where said two down-turned edges of said at least one top surface are restrained from orthogonal transverse movement by said at least two supports, where said diaphragm is clamped by said two hingedly-connected panels of said at least two supports at the ends of said diaphragm, and where said diaphragm includes fixtures to engage and interlock with said at least two supports.

2. The knockdown desk of claim 1 where said diaphragm is in direct contact with the underside of said at least one top surface as a support.

3. The knockdown desk of claim 1 where said two down-turned edges of said at least one top surface are disposed outwardly.

4. The knockdown desk of claim 1 where said hingedly-connected panels comprise at least one of a solid panel, an open frame, a storage unit, and a leg assembly.

5. The knockdown desk of claim 1 where said two hingedly-connected panels are hinged with butt hinges.

6. The knockdown desk of claim 3 whereby pivot points of said two hingedly-connected panels are disposed outwardly of said at least two supports.

* * * * *